US006996522B2

(12) United States Patent
Chen

(10) Patent No.: US 6,996,522 B2
(45) Date of Patent: Feb. 7, 2006

(54) CELP-BASED SPEECH CODING FOR FINE GRAIN SCALABILITY BY ALTERING SUB-FRAME PITCH-PULSE

(75) Inventor: Fang-Chu Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 667 days.

(21) Appl. No.: 09/950,633

(22) Filed: Sep. 13, 2001

(65) Prior Publication Data

US 2002/0133335 A1 Sep. 19, 2002

Related U.S. Application Data

(60) Provisional application No. 60/275,111, filed on Mar. 13, 2001.

(51) Int. Cl.
*G10L 19/04* (2006.01)

(52) U.S. Cl. ..... 704/219; 704/223; 704/229

(58) Field of Classification Search ..... 704/219, 704/264, 238, 270, 267, 500, 220, 222, 200.1, 704/203, 207, 212, 223, 236, 229, 208, 214; 382/238

See application file for complete search history.

(56) References Cited

U.S. PATENT DOCUMENTS 3,892,919 A * 7/1975 Ichikawa ..... 704/267
5,073,940 A * 12/1991 Zinser et al. ..... 704/226
5,097,507 A * 3/1992 Zinser et al. ..... 704/226
5,233,660 A * 8/1993 Chen ..... 704/208
5,271,089 A * 12/1993 Ozawa ..... 704/222
5,651,090 A * 7/1997 Moriya et al. ..... 704/200.1
5,717,824 A * 2/1998 Chhatwal ..... 704/222
5,729,694 A * 3/1998 Holzrichter et al. ..... 704/270
5,732,389 A * 3/1998 Kroon et al. ..... 704/223
6,009,395 A * 12/1999 Lai et al. ..... 704/264
6,055,496 A * 4/2000 Heidari et al. ..... 704/222
6,148,288 A 11/2000 Park
6,249,758 B1 * 6/2001 Mermelstein ..... 704/220
6,301,558 B1 * 10/2001 Isozaki ..... 704/228

(Continued)

OTHER PUBLICATIONS

Zad-Issa et al ("A New LPC Error Criterion For Improved Pitch Tracking", Workshop on Speech Coding For Telecommunication Proceeding, Sep. 1997).*

(Continued)

*Primary Examiner*—Vijay B. Chawan
(74) *Attorney, Agent, or Firm*—Finnegan, Henderson, Farabow, Garrett & Dunner, L.L.P.

(57) ABSTRACT

Methods and systems for providing a CELP-based speech coding with fine grain scalability include a parameter encoder that generates a basic bit-stream from LPC coefficients for a frame, pitch-related information for all the sub-frames obtained by searching an adaptive codebook, and first pulse-related information for even sub-frames obtained by searching a fixed codebook. The parameter encoder also generates enhancement bits, which are preceded by the basic bit-stream, from second pulse-related information for odd sub-frames. The quality of synthesized speech is improved on a basis of one additional odd sub-frame pulse, as more of the second pulse-related information in the enhancement bits is received by a decoder.

18 Claims, 7 Drawing Sheets

U.S. PATENT DOCUMENTS

| | | | | |
|---|---|---|---|---|
| 6,311,154 | B1 * | 10/2001 | Gersho et al. | 704/219 |
| 6,345,255 | B1 * | 2/2002 | Mermelstein | 704/500 |
| 6,556,966 | B1 * | 4/2003 | Gao | 704/220 |
| 6,574,593 | B1 * | 6/2003 | Gao et al. | 704/222 |
| 6,687,666 | B2 * | 2/2004 | Ehara et al. | 704/207 |
| 6,714,907 | B2 * | 3/2004 | Gao | 704/220 |
| 6,731,811 | B1 * | 5/2004 | Rose | 382/238 |
| 6,732,070 | B1 * | 5/2004 | Rotola-Pukkila et al. | 704/219 |
| 6,760,698 | B2 * | 7/2004 | Gao | 704/207 |
| 6,801,499 | B1 * | 10/2004 | Anandakumar et al. | 370/229 |
| 2003/0028386 | A1 * | 2/2003 | Zinser et al. | 704/500 |

OTHER PUBLICATIONS

Fang-Chu Chen, "Suggested new bit rates for ITU-T G.723.1," Electronics Letters, vol. 35, No. 18, Sep. 2, 1999, pp. 1-2.

ISO/IEC JTC1/SC29/WG11, "Information Technology—Generic Coding of Audio-Visual Objects: Visual," ISO/IEC 14496-2 / Amd X, Working Draft 3.0, Draft of Dec. 8, 1999.

ITU-T Recommendation G. 723 1, International Telecommunication Union.

* cited by examiner

| Parameters coded | Subframe 0 | Subframe 1 | Subframe 2 | Subframe 3 | Total |
|---|---|---|---|---|---|
| LPC indices (LPC) | | | | | 24 |
| Adaptive codebook lags (ACL) | 7 | 2 | 7 | 2 | 18 |
| All gains combined (GAIN) | 12 | 12 | 12 | 12 | 48 |
| | | 8 | | 8 | 40 |
| Pulse positions (POS) | 12 | 12 | 12 | 12 | 48 |
| | | 0 | | 0 | 24 |
| Pulse signs (PSIG) | 4 | 4 | 4 | 4 | 16 |
| | | 0 | | 0 | 8 |
| Grid index (GRID) | 1 | 1 | 1 | 1 | 4 |
| | | 0 | | 0 | 2 |
| Total | | | | | 158 |
| | | | | | 116 |

FIG. 2

| Transmitted octets | Bit order |
|---|---|
| 1 | LPC B5...LPC B0, VADFLAG_B0,RATEFLAG_B0 |
| 2 | LPC_B13...,LPC_B6 |
| 3 | LPC_B21...LPC_B14 |
| 4 | ACL0_B5...ACL0_B0,LPC_B23,LPC_B22 |
| 5 | ACL2_B4...ACL2_B0,ACL1_B1,ACL1_B0,ACL0_B6 |
| 6 | GAIN0_B3...GAIN0_B0, ACL3_B1,ACL3_B0,ACL2_B6,ACL2_B5 |
| 7 | GAIN0_B11...GAIN0_B4 |
| 8 | GAIN1_B11...GAIN1_B4 |
| 9 | GAIN_B7...GAIN2_B0 |
| 10 | GAIN3_B7...GAIN3_B4,GAIN2_B11...GAIN2_B8 |
| 11 | PSIG0_B1, PSIG0_B0, GRID2_B0, GRID0_B0, GAIN3_B11...GAIN3_B8 |
| 12 | POS0_B1, POS0_B0, PSIG2_B3...PSIG2_B0, PSIG0_B3, PSIG0_B2 |
| 13 | POS0_B9...POS0_B2, |
| 14 | POS2_B5...POS2_B0, POS0_B11, POS0_B10 |
| 15-1 | POS2_B11...POS2_B6 |
| 15-2 | GAIN1_B1, GAIN1_B0 |
| 16 | POS1_B0, PSIG1_B3...PSIG1_B0, GRID1_B0, GAIN1_B3, GAIN1_B2 |
| 17 | POS1_B8...POS1_B1 |
| 18 | GRID3_B0, GAIN_B3...GAIN3_B0, POS1_B11...POS1_B9 |
| 19 | POS3_B3...POS3_B0, PSIG3_B3....PSIG3_B0 |
| 20 | POS3_B11...POS3_B4, |

Reorder

BASIC BITSTREAM

ENCHANCEMENT BITS

FIG. 3

CELP-BASED SPEECH CODING FOR FINE GRAIN SCALABILITY BY ALTERING SUB-FRAME PITCH-PULSE

RELATED APPLICATION DATA

The present application is related to and claims the benefit of U.S. Provisional Application No. 60/275,111, filed on Mar. 13, 2001, entitled "Scalable Speech Codec," which is expressly incorporated in its entirety herein by reference.

BACKGROUND OF THE INVENTION

1. Field of the Invention

The present invention is generally related to speech coding and, more particularly, to methods and systems for realizing scalable speech codecs with fine grain scalability (FGS) in a CELP-type (Code Excited Linear Predictive) coder.

2. Background

The flexibility of bandwidth usage in a transmission channel has become a major issue in recent multimedia developments, where the amount of data and number of users occupying the channel are often unknown at the time of encoding. Multi-bit-rate source coding is one of the solutions. In accordance with this type of coding, a scalable source codec apparatus with FGS, which requires only one set of encoding algorithms while allowing the channel and a decoder the freedom to discard various numbers of bits in the bit-stream, has become favored in the next generation of communication standards.

For example, general audio and video coding algorithms with FGS have been adopted as part of MPEG-4, which is the international standard (ISO/IEC 14496). The FGS algorithms used in MPEG-4 general audio and video share a common strategy, in that the enhancement layers are distinguished by the different bit significance level at which a bit plane or a bit array is sliced from the spectral residual. The enhancement layers are so ordered that those containing less important information are placed closer to the end of the bit-stream. Therefore, when the length of the bit-stream to be transmitted is shortened, those enhancement layers at the end of the bit-stream, i.e., with the least bit significance levels, will be discarded first.

FGS, although being implemented for audio and video, is not yet applied to speech. This method as it is may not work well for a highly parametric codec with high compression rate (in other words, low bit rate transmission), such as CELP-based ITU-T G.729, G.723.1, and GSM (Global System for Mobile communications) speech codecs. These speech codecs all use LPC-filtered (Linear Predictive Coding) pulses for compensating the residual signals. Due to this difference in coding structure between the CELP algorithms and the MPEG-4 audio and video coding, a CELP-based FGS speech codec has not been fully developed.

SUMMARY OF THE INVENTION

Methods and systems consistent with the present invention encode a speech signal and synthesize speech in a code excited linear prediction (CELP)-based speech processing system that includes an adaptive codebook and a fixed codebook. The speech signal is divided into frames and each frame is further divided into various numbers of sub-frames.

In the encoding, linear prediction coding (LPC) coefficients are generated for a frame, and pitch-related information is generated by using the adaptive codebook for each sub-frame of the frame. First and second pulse-related information are generated by using the fixed codebook, for a part of the sub-frames of the frame and for the remainder of the sub-frames of the frame, respectively. Then, a basic bit-stream is generated from the LPC coefficients, the pitch-related information, and the first pulse-related information. Enhancement bits are generated from the second pulse-related information.

In the synthesizing, the basic bit-stream which includes linear prediction coding (LPC) coefficients for a frame, pitch-related information for all sub-frames of the frame, and first pulse-related information for a part of the sub-frames is received. Additionally, enhancement bits which include a part or a whole of second pulse-related information for a remainder of the sub-frames are received. Then, an excitation is generated by referring to the adaptive codebook and the fixed codebook based on the pitch-related information included in the basic bit-stream and the first pulse-related information included in the basic bit-stream, respectively. An excitation is also generated by referring to the adaptive codebook and the fixed codebook based on the pitch-related information included in the basic bit-stream and the part or the whole of the second pulse-related information included in the enhancement bits, respectively. Lastly, output speech is synthesized according to the excitations and the LPC coefficients.

BRIEF DESCRIPTION OF THE DRAWINGS

The accompanying drawings provide a further understanding of the invention and are incorporated in and constitute a part of this specification. The drawings illustrate various embodiments of the invention and, together with the description, serve to explain the principles of the invention.

FIG. 2 shows a bit allocation in the low bit rate codec of ITU-T G.723.1, and an exemplary bit allocation for a "basic" bit-stream consistent with the present invention;

FIG. 3 shows an exemplary bit-reordering table for the low bit rate codec of ITU-T G.723.1, where the "basic" bit-stream and "enhancement" bits can be divided, in a manner consistent with the present invention;

DETAILED DESCRIPTION

The following detailed description refers to the accompanying drawings. Although the description includes exemplary implementations, other implementations are possible and changes may be made to the implementations described without departing from the spirit and scope of the invention. The following detailed description does not limit the invention. Instead, the scope of the invention is defined by the appended claims. Wherever possible, the same reference numbers will be used throughout the drawings and the following description to refer to the same or like parts.

According to the embodiments of the present invention described below, not only "bit rate scalability" but also "fine grain scalability (FGS)" can be provided. A speech codec is considered to have "bit rate scalability," if a single set of encoding schemes produces a bit-stream including a number of blocks of bits and a decoder can output speech with higher quality as more of the blocks are received. Bit rate scalability is important when the channel traffic between the encoder and the decoder is unpredictable. This is because, under such circumstances, it is desirable for the decoder to provide speech with quality commensurate with available bandwidth in the channel, even though the speech has been encoded irrespective of the available bandwidth.

A coding structure with "FGS" includes a "base" layer (referred to herein as the "basic" bit-stream) and one or more "enhancement" layers (referred to herein as the "enhancement" bits). "Fine grain" as used herein indicates that a minimum number of enhancement bits can be discarded at any one time. The base layer itself can reproduce speech with minimum quality, whereas the enhancement layers in combination with the base layer improve the quality. As a result, the loss of the base layer will cause damage to the quality in decoded speech, whereas the extent of the enhancement layers received by the decoder determines how much the quality can be improved.

Embodiments of the present invention provide a CELP-based speech coding with the above-described bit rate scalability and FGS. In a CELP-based codec, a human vocal track is modeled as a resonator. This is known as an "LPC model" and is responsible for vowels. A glottal vibration is modeled as an excitation, which is responsible for pitch. That is, the LPC model excited by the periodic excitation signal can generate voiced sounds. Additionally, the residual due to imperfections of the model and limitations of the pitch estimate is compensated for with fixed-code pulses, which are also responsible for consonants. The FGS is realized in this CELP coding on the basis of the fixed-code pulses, in a manner consistent with the present invention.

Figure 1:
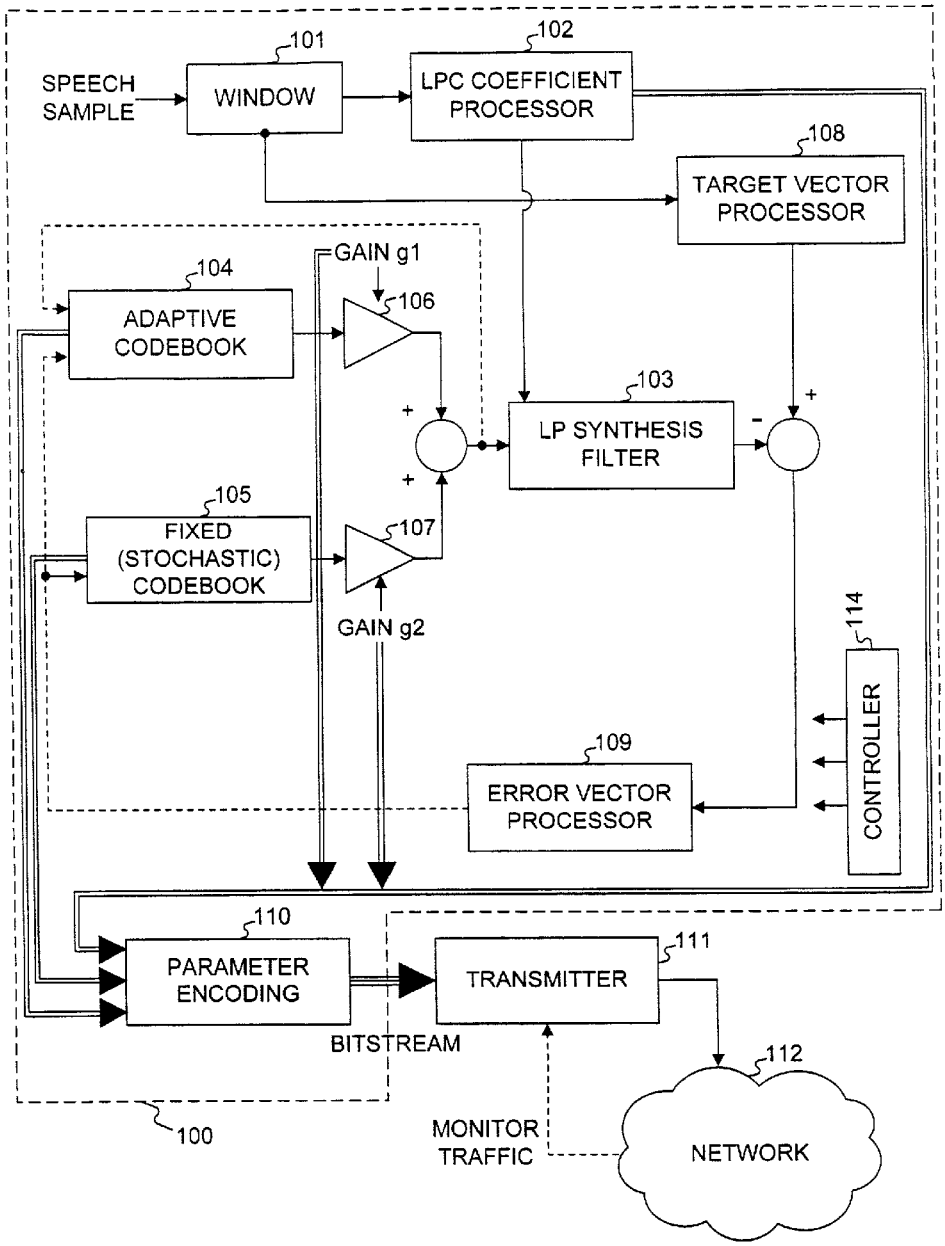
FIG. 1 illustrates an embodiment of a speech encoder consistent with the present invention.

FIG. 1 shows an embodiment of a CELP-type encoder 100 consistent with the present invention. Speech samples are divided into frames and input to window 101. A current speech frame is windowed by window 101, and then enters an LPC-analysis stage. An LPC coefficient processor 102 calculates LPC coefficients based on the speech frame. The LPC coefficients are input to an LP synthesis filter 103. In addition, the speech frame is divided into sub-frames, and an "analysis-by-synthesis" is performed based on each sub-frame.

In an analysis-by-synthesis loop, the LP synthesis filter 103 is excited by an excitation vector including an "adaptive" part and a "stochastic" part. The adaptive excitation is provided as an adaptive excitation vector from an adaptive codebook 104, and the stochastic excitation is provided as a stochastic excitation vector from a fixed (stochastic) codebook 105.

The adaptive excitation vector and the stochastic excitation vector are scaled by amplifier 106 with gain g1 and by amplifier 107 with gain g2, respectively, and the sum of the scaled adaptive and the scaled stochastic excitation vectors is then filtered by LP synthesis filter 103 using the LPC coefficients that have been calculated by processor 102. The output from LP synthesis filter 103 is compared to a target vector, which is generated by a target vector processor 108 and represents the input speech sample, so as to produce an error vector. The error vector is processed by an error vector processor 109. Then, codebooks 104 and 105, along with gains g1 and g2, are searched to choose vectors and the best gain values for g1 and g2, such that the error is minimized.

Through the above-described adaptive and fixed codebook search, the excitation vectors and gains that give the "best" approximation to the speech sample are chosen. Then, the following information items are input to parameter encoding device 110: (1) LPC coefficients of the speech frame from LPC coefficient processor 102; (2) adaptive code pitch information obtained from adaptive codebook 104; (3) gains g1 and g2; and (4) fixed-code pulse information obtained from stochastic codebook 105. The information items (2)–(4) correspond to the "best" excitation vectors and gains and are produced for each sub-frame. Parameter encoding device 110 then encodes the information items (1)–(4) to create a bit-stream. This bit-stream is transmitted to a decoder, and the decoder decodes it into synthesized speech.

In accordance with the present embodiment, the "basic" bit-stream includes the following information items: (a) the LPC coefficients of the frame; (b) the adaptive code pitch information and gain g1 of all the sub-frames; and (c) the fixed-code pulse information and gain g2 of even sub-frames. The "enhancement" bits include (d) the fixed-code pulse information and gain g2 of odd sub-frames. The fixed-code pulse information includes, for example, pulse positions and pulse signs. Hereinafter, the information item (b) is referred to as a "pitch lag/gain," and the information items (c) or (d) are referred to as "stochastic code/gain."

For the FGS, the basic bit-stream is the minimum requirement and is transmitted to the decoder in order to generate "acceptable" synthesized speech. The enhancement bits, on the other hand, can be ignored, but are used in the decoder for speech enhancement with a better quality than "acceptable." When a variation of the speech between two adjacent sub-frames is slow, the excitation of the previous sub-frame can be reused for the current sub-frame with only pitch lag/gain updates while retaining comparable speech quality.

More specifically, in the "analysis-by-synthesis" loop of the CELP coding, the excitation of the current sub-frame is first extended from the previous sub-frame and later corrected by the "best" match between the target and the synthesized speech. Therefore, if the excitation of the previous sub-frame is guaranteed to generate good speech quality of that sub-frame, the extension (in other words, reuse) of it with new pitch lag/gain updates of the current sub-frame leads to the generation of speech quality comparable to that of the previous sub-frame. Consequently, even if the stochastic code/gain search is performed only for every other sub-frame, the acceptable speech quality can be achieved.

FIG. 2 shows a bit allocation according to the 5.3 kbit/s G.723.1 standard and that of the "basic" bit-stream in the present embodiment. In the entries with two numbers, the number on top is the bit number required by G.723.1, and the number on the bottom is the bit number of the "basic" bit-stream according to the present embodiment. The pitch lag/gain (adaptive codebook lags and 8-bit gains) are determined for every sub-frame, whereas the stochastic code/gain (remaining 4-bit gains, pulse positions, pulse signs and grid index) of even sub-frames are included in the "basic" bit-stream but not those of odd sub-frames. When only this "basic" bit-stream is received, the excitation signal of the odd sub-frame is constructed through SELP (Self-code Excitation Linear Prediction), i.e., deriving from the previous even sub-frame without resorting to the stochastic codebook.

As can be seen from FIG. 2, for the "basic" bit-stream, the total number of bits is reduced from 158 to 116, and the bit rate is reduced from 5.3 kbit/s to 3.9 kbit/s, which is a 27% reduction. Nonetheless, this "basic" bit-stream itself generates speech with only approximately 1 dB SEGSNR (SEGmental Signal-to-Noise Ratio) degradation in its quality compared to that of the full bit-stream. Therefore, the "basic" bit-stream satisfies the minimum requirement for synthesized speech quality, and the "enhancement" bits are dispensable as a whole or in part.

For bit rate scalability, the "basic" bit-stream followed by a number of "enhancement" bits are transmitted. The "enhancement" bits carry the information about the fixed code vectors and gains for odd sub-frames, and represent a number of pulses. As information about more of the pulses for odd sub-frames is received, the decoder can output speech with higher quality. In order to achieve this scalability by adding the pulses back to the odd sub-frames, the bit ordering in the bit-stream is rearranged, and the coding algorithm is partly modified, as described in detail below.

FIG. 3 shows an example of the bit reordering of the low bit rate coder of G.723.1. The number of total bits in a full bit-stream of a frame and the bit fields are the same as that of a standard codec. The bit order, however, is modified to accommodate the ability of flexible bit rate transmission. First, those bits in the "basic" bit-stream are transmitted before the "enhancement" bits. Then, the "enhancement" bits are ordered such that bits for pulses of one odd sub-frame are grouped together, and that, within one odd sub-frame, the bits for pulse signs and gains precede those of pulse positions. With this new order, pulses are abandoned in a way that all the information of one sub-frame is discarded before another sub-frame is affected.

Figure 4:
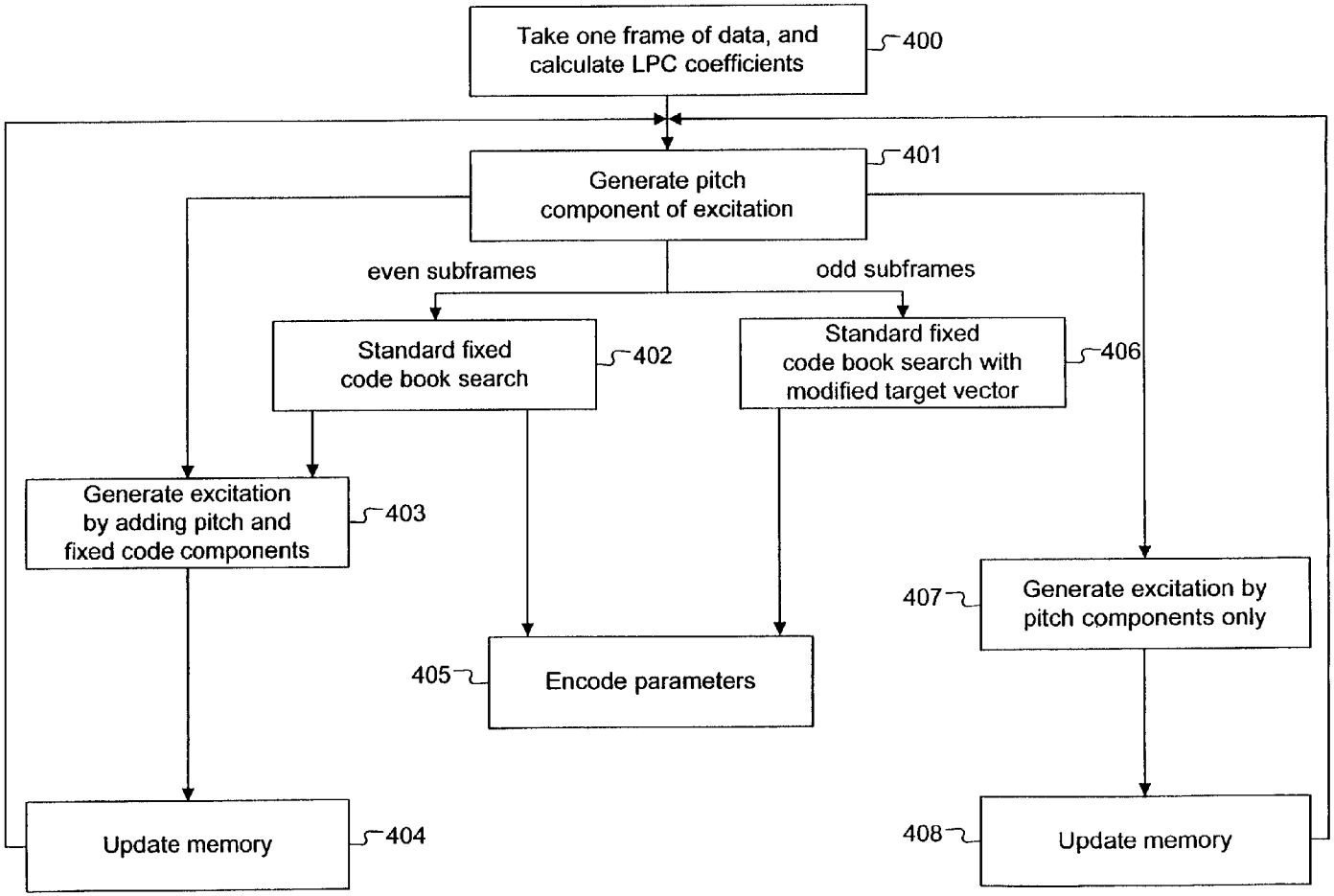
FIG. 4 is a flowchart showing an encoding process consistent with the present invention.

FIG. 4 is a flowchart showing an example of a modified algorithm for encoding one frame of data. A controller 114 of FIG. 1 may control each element in encoder 100 according to this flowchart. First, one frame of data is taken and LPC coefficients are calculated (step 400). Then, adaptive codebook 104 and amplifier 106 generate the pitch component of excitation for a given sub-frame (step 401). If the given sub-frame is an even sub-frame, a standard fixed codebook search is performed using fixed codebook 105 and amplifier 107 (step 402). Then, the excitation is generated by adding the pitch component from step 401 and the fixed-code component from step 402 to be input to LP synthesis filter 103 (step 403). The excitation generated from step 403 is used in updating memory states for the use of the next sub-frame (step 404). This corresponds to feeding back the excitation to adaptive codebook 104 as shown in FIG. 1. The searched results are provided to parameter encoding device 110 (step 405).

If the given sub-frame is an odd sub-frame, a fixed codebook search is performed with a modified target vector (step 406). Modification of the target vector is explained below. The excitation generated by adding the pitch component from step 401 and the fixed-code component from step 406 is input to LP synthesis filter 103 only when performing the fixed codebook search. The results of the search are then provided to parameter encoding device 110, along with other parameters (step 405). As another modification in the coding algorithm, a different excitation is used in updating the memory states for the next sub-frame (step 408). The different excitation is generated from only the pitch component from step 401 while ignoring the result generated by step 406.

The odd sub-frame pulses are controlled in step 408 to not be recycled between the sub-frames. Since the encoder has no information about the number of odd sub-frame pulses actually used by the decoder, the encoding algorithm is determined assuming the worst case in which the decoder receives only the "basic" bit-stream. Thus, the excitation vector and the memory states without any odd sub-frame pulses are passed down from an odd sub-frame to the next even sub-frame. The odd sub-frame pulses are still searched (step 406) and generated (step 407) in order to be added to the excitation for enhancing the speech quality of that sub-frame (step 405), but are not recycled in future sub-frames.

In this way, the consistency of the closed-loop analysis-by-synthesis method can be preserved. If the encoder reused any of the odd sub-frame pulses which were not used by the decoder, the code vectors selected for the next sub-frame might not be the right choice for the decoder and an error would occur. This error would then propagate and accumulate throughout the subsequent sub-frames on the decoder side and eventually cause the decoder to break down. The modification embodied in step 408 thus prevents the error and trouble.

The modified target vector is used in step 406 in order to smooth some discontinuity effects caused by the above-described non-recycled odd sub-frame pulses processed in the decoder. Since the speech components generated from the odd sub-frame pulses to enhance the speech quality are not fed back through LP synthesis filter 103 and error vector processor 109 in the encoder, they would introduce a degree of discontinuity at the sub-frame boundaries in the synthesized speech if used in the decoder. This discontinuity can be decreased by gradually reducing the effects of the pulses on, for example, the last ten samples of each odd sub-frame, because ten speech samples from the previous sub-frame are needed in a tenth-order LP synthesis filter.

Specifically, since the LPC-filtered pulses are chosen to best mimic a target vector in the analysis-by-synthesis loop, target vector processor 108 linearly attenuates the magnitude of the last ten samples of the target vector, prior to the fixed codebook search of each odd sub-frame in step 406. This modification of the target vector not only reduces the effects of the odd sub-frame pulses but also makes sure that the integrity of the well-established fixed codebook search algorithm is not altered.

Figure 5:
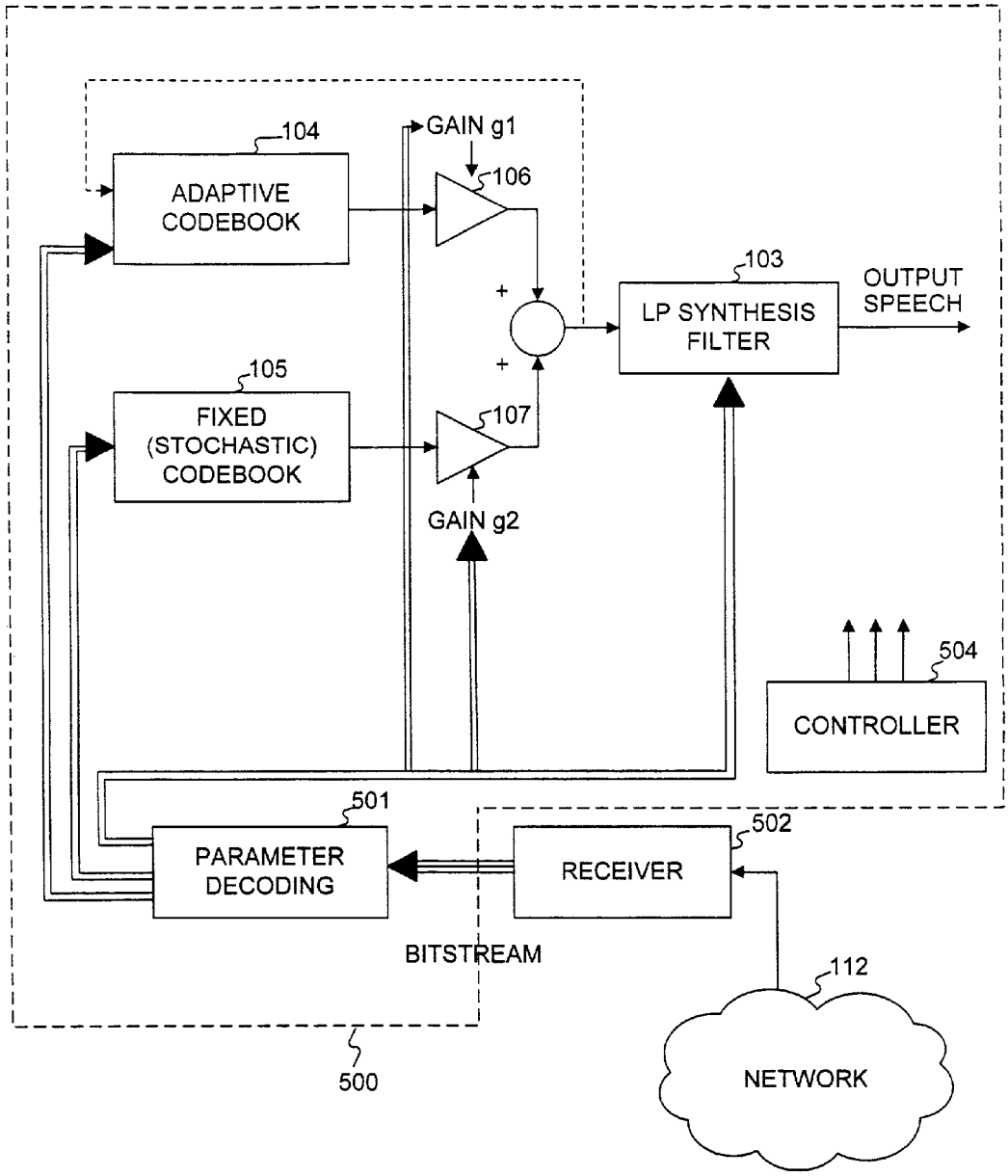
FIG. 5 illustrates an embodiment of a speech decoder consistent with the present invention.

FIG. 5 shows an embodiment of a CELP-type decoder 500 consistent with the present invention. An adaptive codebook 104, a fixed codebook 105, amplifiers 106 and 107, and LP synthesis filter 103 in decoder 500 have the same reference number as in FIG. 1, since decoder 500 is constructed to produce the same result as encoder 100 does in the analysis-by-synthesis loop.

The whole or a part of the bit-stream transmitted from the encoder is input to a parameter decoding device 501. Parameter decoding device 501 decodes the received bit-stream, and then outputs the LPC coefficients to LP synthesis filter 103, the pitch lag/gain to adaptive codebook 104 and amplifier 106 for every sub-frame, and the stochastic code/gain to fixed codebook 105 and amplifier 107 for each even sub-frame. The stochastic code/gain of odd sub-frames are given to fixed codebook 105 and amplifier 107 if contained in the received bit-stream. Then, an excitation generated by adaptive codebook 104 and amplifier 106 and an excitation generated by fixed codebook 105 and amplifier 107 are added, and then synthesized into speech by LP synthesis filter 103. The encoder 100 and decoder 500 may be implemented in a DSP processor.

Figure 6:
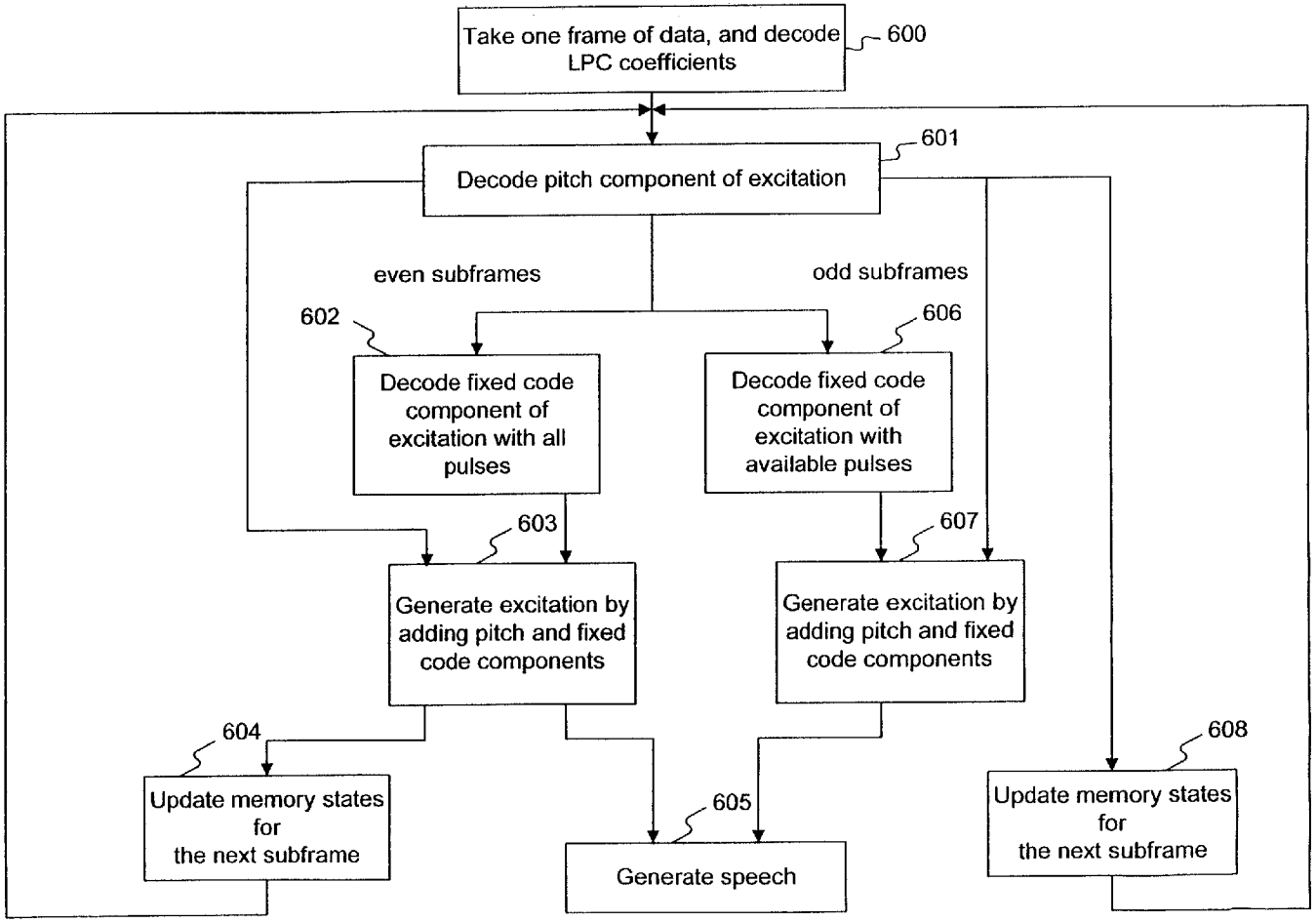
FIG. 6 is a flowchart showing a decoding process consistent with the present invention.

FIG. 6 is a flowchart showing an example of a decoding algorithm consistent with the present invention. A controller 504 of FIG. 5 may control each element in decoder 500 according to this flowchart.

With reference to FIG. 6, first, one frame of data is taken and LPC coefficients are calculated (step 600). Then, the pitch component of excitation for a given sub-frame is generated (step 601). If the given sub-frame is an even sub-frame, a fixed-code component of excitation with all pulses is generated (step 602). Then, the excitation is generated by adding the pitch component from step 601 and the fixed-code component from step 602 to be input to LP synthesis filter 103 (step 603). The excitation generated from step 603 is used in updating memory states for the next sub-frame (step 604). This corresponds to feeding back the excitation to adaptive codebook 104 as shown in FIG. 5. LP synthesis filter 103 generates the speech from the excitation (step 605).

If the given sub-frame is an odd sub-frame, a fixed-code component of excitation with available pulses is generated (step 606). The number of available pulses depends on how many "enhancement" bits are received in addition to the "basic" bit-stream. The excitation is generated by adding the pitch component from step 601 and the fixed-code component from step 606 to be input to LP synthesis filter 103 (step 607), and then the speech is synthesized (step 605). Similarly to encoder 100, decoder 500 is modified such that the excitation generated from step 607 is not used in updating the memory states for the next sub-frame. That is, the fixed-code components of any odd sub-frame pulses are removed, and the pitch component of the current odd sub-frame is used in the update for the next even sub-frame (step 608).

With the above-described coding system, encoder 100 encodes and provides the full bit-stream to a channel supervisor, for example, provided in transmitter 111 in FIG. 1. This supervisor can discard up to 42 bits from the end of the full bit-stream to be transmitted, depending on the channel traffic in network 112.

Then, receiver 502 in FIG. 5 receives the non-discarded bits from network 112 and transfers them to the decoder. Decoder 500 then decodes the bit-stream on the basis of each pulse, according to the number of the bits received. If the number of enhancement bits received is not enough to decode one specific pulse, that pulse will be abandoned. Roughly speaking, this leads to a resolution of 3 bits between 118 bits and 160 bits per frame, which means a resolution of 0.1 kbit/s within the bit rate range from 3.9 kbit/s to 5.3 kbit/s.

The above-mentioned numbers of bits and the bit rates are used when the above-described coding scheme is applied to the low rate codec of G.723.1. For other CELP-based speech codec, the numbers of bits and the bit rates will be different.

With this implementation, the FGS is realized without extra overhead or heavy computation loads, since the full bit-stream consists of the same elements as the standard codec. Moreover, within a reasonable bit rate range, a single set of encoding schemes is enough for each one of the FGS-scalable codecs.

Figure 7:
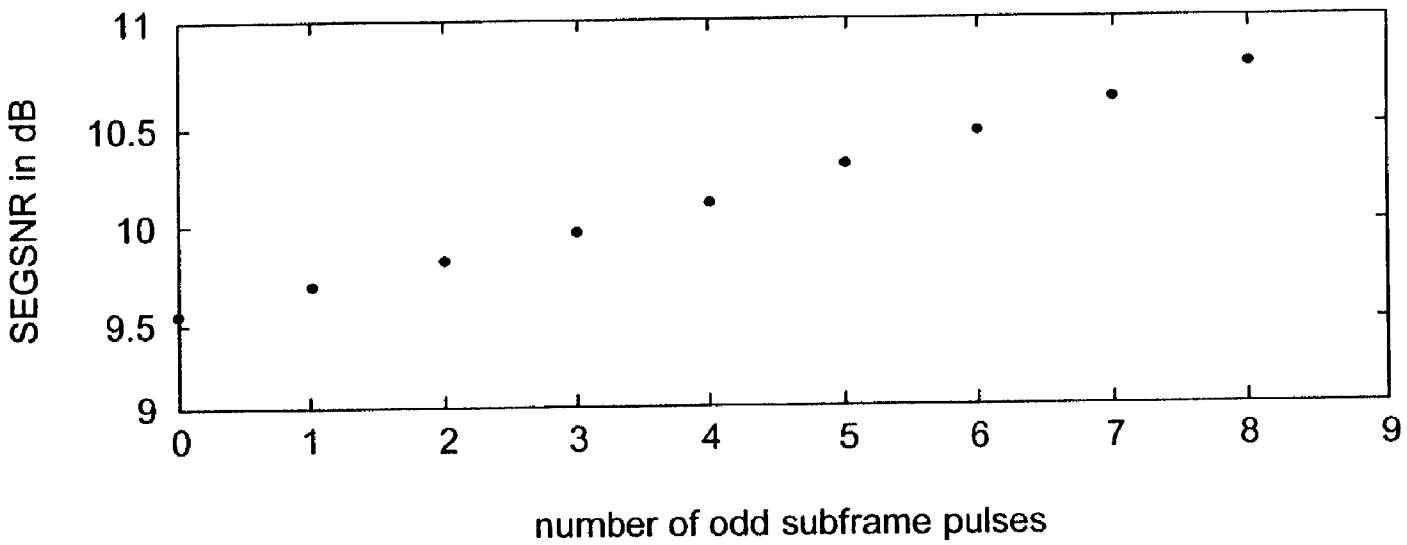
FIG. 7 depicts an example of scalability provided in accordance with the embodiments of the present invention.

An example of the realized scalability in a computer simulation is shown in FIG. 7. In this example, the above-described embodiments were applied to the low rate coder of G.723.1, and a 53-second speech was used as a test input. The 53-second speech is distributed, as a file named 'in5.bin,' with ITU-T G.728.

Theoretically, the worst case of the speech quality decoded by such a FGS scalable codec is when all 42 enhancement bits are discarded. As pulses are added back, the speech quality is expected to improve. In the performance curve shown in FIG. 7, the SEGSNR values of each decoded speech are plotted against the number of pulses used in sub-frame 1 and 3 (the same for all frames).

With each odd sub-frame being allowed four pulses and the bits being assembled in the manner shown in FIG. 3, if the number of odd sub-frame pulses is less than eight and greater than four, the missing pulses are from sub-frame 3. If the number of pulses is less than four, the obtained pulses are all from sub-frame 1. In the worst case when the pulse number is zero, it indicates that no pulses are used by the decoder in any odd sub-frame. This graph demonstrates that the speech quality depends on the number of enhancement bits available in the decoder, which means that this speech codec is scalable.

Persons of ordinary skill will realize that many modifications and variations of the above embodiments may be made without departing from the novel and advantageous features of the present invention. Accordingly, all such modifications and variations are intended to be included within the scope of the appended claims. The specification and examples are only exemplary. The following claims define the true scope and sprit of the invention.

I claim:

1. A method of encoding a speech signal in a code excited linear prediction (CELP)-based speech processing system that includes an adaptive codebook and a fixed codebook, wherein the speech signal is divided into frames and each frame is further divided into sequential sub-frames, the method comprising:

generating linear prediction coding (LPC) coefficients for a frame;

generating pitch-related information by using the adaptive codebook, for the sequential sub-frames of the frame;

generating fixed-code pulse information by using the fixed codebook, for a plurality of selected sub-frames of the frame;

generating a first bit-stream corresponding to the frame for the LPC coefficients, the pitch-related information, and the fixed-code pulse information for the plurality of selected sub-frames;

generating fixed-code pulse information by using the fixed codebook, for unselected sub-frames; and separately generating a second bit-stream corresponding to speech enhancement of the frame from the fixed-code pulse information for the unselected sub-frames.

2. The method of claim 1, wherein the first bit-stream provides a minimum quality when synthesized into speech, and the second bit-stream provides improved quality of the synthesized speech.

3. The method of claim 2, wherein the selected sub-frames are even sub-frames of the frame, and the unselected sub-frames are odd sub-frames of the frame.

4. The method of claim 1, further comprising placing the second bit-stream after the first bit-stream.

5. The method of claim 4, wherein the generating of fixed-code pulse information for the unselected sub-frames includes generating information for a plurality of pulses, and in the second bit-stream, placing all information for one pulse before information of another pulse.

6. The method of claim 1, further comprising:

using the pulse-related information in addition to the pitch-related information for a selected sub-frame to generate pitch-related information and fixed-code pulse information for a succeeding sub-frame; and using the pitch-related information without the pulse-related information for an unselected sub-frame to generate pitch-related information and fixed-code pulse information for a succeeding sub-frame.

7. The method of claim 1, further comprising:

searching the adaptive codebook and the fixed codebook to minimize a difference between a synthesized speech and a target signal to generate the pitch-related information and the fixed-code pulse information; and linearly attenuating a magnitude of samples in the target signal for an unselected sub-frame, the number of samples corresponding to the order of an LP-synthesis filter.

8. A method of synthesizing speech in a code excited linear prediction (CELP)-based speech processing system that includes an adaptive codebook and a fixed codebook, wherein a speech signal is divided into frames and each frame is further divided into sub-frames, the method comprising:

receiving a basic bit-stream which includes linear prediction coding (LPC) coefficients for a frame, pitch-related information for all sub-frames of the frame, and first pulse-related information for a plurality of selected sub-frames of the frame;

receiving enhancement bits which include second pulse-related information for unselected sub-frames of the frame;

generating an excitation by referring to the adaptive codebook based on the pitch-related information included in the basic bit-stream; and by referring to the fixed codebook based on the first pulse-related information included in the basic bit-stream;

generating an excitation by referring to the adaptive codebook based on the pitch-related information included in the basic bit-stream and by referring to the fixed codebook based on the part or the whole of the second pulse-related information included in the enhancement bits; and outputting synthesized speech according to the excitations and the LPC coefficients.

9. The method of claim 8, wherein the plurality of selected sub-frames are even sub-frames of the frame, and the unselected sub-frames of the frame.

10. The method of claim 8, wherein the second pulse-related information includes information for a plurality of pulses, and quality of the synthesized speech is improved each time information for one pulse is added to the enhancement bits received.

11. The method of claim 8, further comprising:

feeding back the excitation generated from the first pulse-related information in addition to the pitch-related information, for generating an excitation for a succeeding sub-frame; and feeding back another excitation generated from the pitch-related information without the second pulse-related information, for generating an excitation for a succeeding sub-frame.

12. A speech processing system based on code excited linear prediction (CELP) for encoding a speech signal, wherein the speech signal is divided into frames and each frame is further divided into sub-frames, the system comprising:

a generator of linear prediction coding (LPC) coefficients for a frame;

a first portion including an adaptive codebook for generating pitch-related information for each sub-frame of the frame;

a second portion including a fixed codebook for generating fixed-code pulse information for each sub-frame of the frame, the pulse-related information including first fixed-code pulse information for a first kind of sub-frame and second fixed-code pulse information for a second kind of sub-frame; and a parameter encoder for generating a basic bit-stream from the LPC coefficients, the pitch-related information, and the first fixed-code pulse information, and for generating enhancement bits from the second pulse-related information.

13. The system according to claim 12, further comprising a transmitter for transmitting the basic bit-stream and a part of the enhancement bits onto a channel, the part being determined based on traffic of the channel.

14. The system according to claim 12, wherein the pitch-related information is reused in the first portion for a succeeding sub-frame, the first fixed-code pulse information being reused in addition to the pitch-related information, the second fixed-code pulse information not being reused.

15. The system according to claim 12, further comprising:

an analysis-by-synthesis loop including a synthesizer for searching the adaptive codebook and the fixed codebook to minimize a difference between a synthesized speech and a target signal; and a target signal processor for linearly attenuating a magnitude of samples in the target signal provided to the analysis-by-synthesis loop for the second kind of sub-frame, the number of samples corresponding to the order of an LP-synthesis filter.

16. A speech processing system based on code excited linear prediction (CELP) for synthesizing speech, wherein a speech signal is divided into frames and each frame is further divided into sub-frames, the system comprising:

a parameter decoder for extracting linear prediction coding (LPC) coefficients for a frame, pitch-related information for all the sub-frames of the frame, and first pulse-related information for a plurality of selected sub-frames of the frame, from a basic bit-stream received, and for extracting a second pulse-related information for unselected sub-frames of the frame from enhancement bits received;

a first portion including an adaptive codebook for generating an excitation based on the pitch-related information;

a second portion including a fixed codebook for generating an excitation based on the first pulse-related information or based on the second pulse-related information; and a synthesizer for outputting synthesized speech according to the excitations and the LPC coefficients.

17. The system according to claim 16, wherein the second pulse-related information includes information for a plurality of pulses, and the parameter decoder extracts, from the enhancement bits received, information for each pulse and provides the second portion with the information for each pulse.

18. The system according to claim 16, wherein:

the excitation generated from the pitch-related information is fed back to the first portion for a succeeding sub-frame, the excitation generated from the first pulse-related information being fed back in addition to the excitation from the pitch-related information, and the excitation generated from the second pulse-related information not being fed back.

* * * * *

UNITED STATES PATENT AND TRADEMARK OFFICE

CERTIFICATE OF CORRECTION

PATENT NO. : 6,996,522 B2
APPLICATION NO. : 09/950633
DATED : February 7, 2006
INVENTOR(S) : Fang-Chu Chen It is certified that error appears in the above-identified patent and that said Letters Patent is hereby corrected as shown below:

Title page, Item [54] and Column 1, line 2,
Title, "ALTERING" should read -- ALTERNATING --.

Column 8,
Line 33, "for the" should read -- from the --.
Line 53, "pulses, and" should read -- pulses and, --.
Lines 57 and 61-62, "pulse-related" should read -- fixed-code pulse --.

Column 9,
Line 40, "unselected sub-frames of" should read -- unselected sub-frames are odd sub-frames of --.
Line 67, "pulsed-related" should read -- fixed-code pulse --.

Column 10,
Lines 7-8, "pulse-related" should read -- fixed-code pulse --.
Line 11, "the part" should read -- the number of bits in the part --.
Line 62, "being" should read -- is --.
Line 65, "information not being fed" should read -- information is not fed --.

Signed and Sealed this

Twenty-seventh Day of June, 2006

JON W. DUDAS
*Director of the United States Patent and Trademark Office*